US010270201B2

(12) United States Patent
Klerx

(10) Patent No.: US 10,270,201 B2
(45) Date of Patent: Apr. 23, 2019

(54) HOUSING FOR A PLUG-IN CONNECTION

(71) Applicant: TTL NETWORK GMBH, Halle/Westfalen (DE)

(72) Inventor: Guido Klerx, Berkatal (DE)

(73) Assignee: TTL NETWORK GMBH, Halle/Westfalen (DE)

( * ) Notice: Subject to any disclaimer, the term of this patent is extended or adjusted under 35 U.S.C. 154(b) by 0 days.

(21) Appl. No.: 15/767,429

(22) PCT Filed: Oct. 12, 2016

(86) PCT No.: PCT/DE2016/100473
§ 371 (c)(1),
(2) Date: Apr. 11, 2018

(87) PCT Pub. No.: WO2017/063637
PCT Pub. Date: Apr. 20, 2017

(65) Prior Publication Data

US 2018/0294595 A1 Oct. 11, 2018

(30) Foreign Application Priority Data

Oct. 12, 2015 (DE) ..... 10 2015 117 341

(51) Int. Cl.
*H01R 13/506* (2006.01)
*H01R 13/6593* (2011.01)
(Continued)

(52) U.S. Cl.
CPC ..... *H01R 13/506* (2013.01); *H01R 13/6593* (2013.01); *H01R 13/508* (2013.01); *H01R 13/516* (2013.01)

(58) Field of Classification Search
CPC ..... H01R 13/506; H01R 13/6593; H01R 13/508; H01R 13/516
See application file for complete search history.

(56) References Cited

U.S. PATENT DOCUMENTS 4,734,056 A * 3/1988 Bertini ..... H01R 13/516 439/460
4,822,286 A * 4/1989 Bianca ..... H01R 13/582 439/460

(Continued)

FOREIGN PATENT DOCUMENTS

| | | |
|---|---|---|
| EP | 0619626 | 10/1994 |
| EP | 0896393 | 2/1999 |
| WO | WO 99/62145 | 12/1999 |

OTHER PUBLICATIONS

International Search Report prepared by the European Patent Office dated Feb. 7, 2017, for International Application No. PCT/DE2016/100473.

*Primary Examiner* — Briggitte R Hammond
(74) *Attorney, Agent, or Firm* — Sheridan Ross P.C.

(57) ABSTRACT

The invention relates to a housing for a plug-in connection, comprising a lower shell element (100) and an upper shell element (200) that is identical to the lower shell element (100), each shell element (100, 200) containing a retaining element (2), by means of which a plug-in connector (1) can be secured to the housing. Each shell element (100, 200) contains a receptacle (3), in which a cable mount (9) can be received and each shell element (100, 200) has at least one detent element (11, 12, 13, 14) that cooperates with a mating detent element (21, 22, 23, 24) of the other shell element (200, 100). The detent elements (11, 12, 13, 14) and the mating detent elements (21, 22, 23, 24) have a multi-step design and the entire border regions between the shell elements (100, 200) forming the housing, with the exception of openings for the plug-in connector (1) and the cable mount (9), have a multi-step design.

10 Claims, 7 Drawing Sheets

Figure 1:
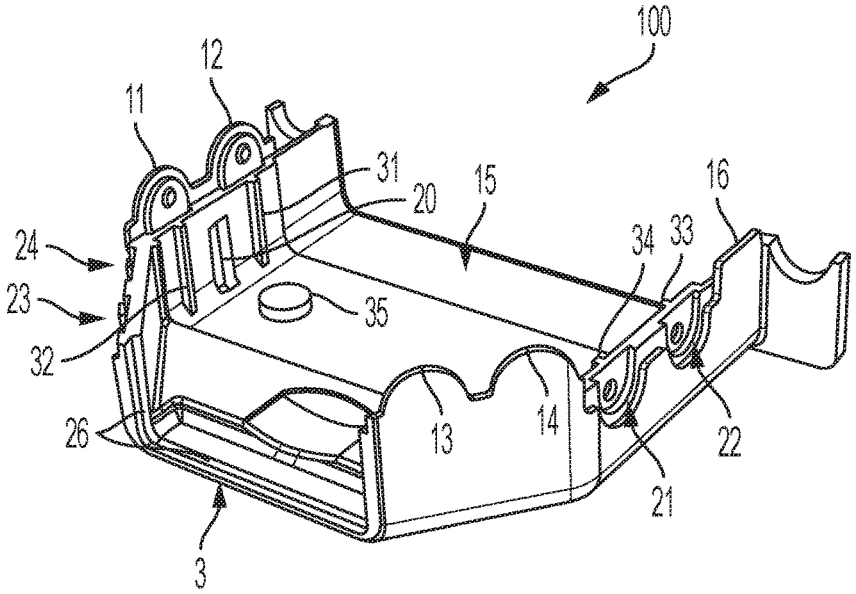

(51) Int. Cl.
*H01R 13/516* (2006.01)
*H01R 13/508* (2006.01)

(56) References Cited

U.S. PATENT DOCUMENTS 4,921,441 A * 5/1990 Sauder ..... H01R 23/661
439/460
6,231,392 B1 * 5/2001 van Woensel ..... H01R 13/5808
439/353
6,354,879 B1 3/2002 Plehaty

* cited by examiner

HOUSING FOR A PLUG-IN CONNECTION

CROSS REFERENCE TO RELATED APPLICATION

This application is a national stage application under 35 U.S.C. 371 and claims the benefit of PCT Application No. PCT/DE2016/100473 having an international filing date of 12 Oct. 2016, which designated the United States, which PCT application claimed priority to German Application No. 10 2015 117 341.7 filed 12 Oct. 2015, the disclosures of each of which are incorporated herein in their entirety by reference.

The invention relates to a housing for a plug-in connection.

Plug-in connections of this type serve to disconnect and connect lines which transmit electric current and/or, for example, also optical radiation. Essential parts of a plug-in connection of this type are firstly a plug-in connector itself, to which contact pins are attached which, on the one hand, can be plugged into a corresponding socket for the plug-in connection and, on the other hand, have corresponding pins for fastening the cable elements which carry the electric current or the optical radiation. Secondly, a plug-in connection of this type has a corresponding cable which is connected to the plug-in connector.

In the case of internal connections, plug-in connections are often not sheathed. If, however, external connections are concerned in the case of plug-in connections of this type, it is appropriate for a plurality of reasons to sheathe the contact point with a corresponding housing. Firstly, a housing of this type, in particular in the case of electric connections, serves to ensure that both users and other cables or units are protected against coming into contact with possibly dangerous voltages which prevail on the cables of the plug-in connections. Furthermore, a housing of this type protects the plug-in connection against dust and corrosion.

Furthermore, a housing of this type also serves to ensure that the cables which are the object of a plug-in connection of this type do not pull directly on the contact points. Said contact points are as a rule namely not designed for a tensile stress to be applied to them, and can therefore also fail. The outgoing cable of a plug-in connection is therefore often clamped fixedly within the plug housing by way of crimping or screw terminals, with the result that the forces can act in a defined manner at said location and therefore effective tensile relief for the contact points is ensured. Even if there is a tensile relief of this type on a plug-in connection, the cable should not be pulled during the release of the plug-in connection, but rather the plug-in connection should be gripped on its housing for release purposes.

It is an important object of the housing, in particular in the case of audio and high frequency connections, to shield the signal line which is established by way of the plug-in connection against the irradiation of interference and to ensure that electromagnetic radiation which emanates from the signal lines does not influence the environment or other components in the device. In the case of shielding of this type, a distinction is to be made between actions as a result of electrical or magnetic fields, actions as a result of electromagnetic waves, and line-bound effects. In general, electromagnetic compatibility is referred to here, which denotes the desired state where technical units do not influence one another in a disruptive manner by way of undesired electrical or electromagnetic effects.

In mass production, plug housings of this type are often produced simply by way of overmolding of the contact part with plastic. In the case of assembly for subsequent releasability, there are variants of pushing said plug housings on with latching or screwing together.

A plug housing which is pushed on is known, for example, from DE 10 2012 022 187 A1.

A plug housing which is produced by way of being screwed together is known, furthermore, from EP 0 981 186 A1.

A common feature of all the known releasable housings is that they have a great variety of components in conjunction with the plug-in connector. It is necessary here to produce and store many individual parts, which have to be produced separately, for the assembly of the housing. In this respect, many production lines have to be provided for the production of the wide variety of individual parts for the production of a plug-in connection of this type, which appears both ecologically and economically questionable.

Furthermore, U.S. Pat. No. 4,108,527 A and US 2004/0102082 A1 have disclosed plug-in connectors in accordance with the preamble of patent claim 1. Said plug-in connectors cannot ensure sufficient protection of the signal line against the irradiation of interference, however. Furthermore, it also cannot be ensured that electromagnetic radiation which emanates from the signal lines does not influence the environment or other components in the device.

It is therefore an object of the invention to provide a housing for a plug-in connection, which housing makes do with as few different individual components as possible and can be assembled in a simple way, with the result that the production of a housing of this type and/or a plug-in connection with a housing of this type satisfies the current requirements of a production method from both an ecological and an economic viewpoint, and appropriate electromagnetic compatibility of the housing is also ensured.

Said object is achieved by way of a housing for a plug-in connection having all the features of patent claim 1. Advantageous refinements of the invention are found in the subclaims.

Here, the housing according to the invention for a plug-in connection has a lower shell element and an upper shell element. Here, the upper and the lower shell element are of identical configuration to one another. Furthermore, a holding element is arranged in each shell element, by way of which holding element a plug-in connector can be fastened to a first open end of the housing. In every shell element, a receptacle is provided at the other open end of the housing, in which receptacle a cable holder can be received. Here, according to the invention, each shell element has at least one latching element which interacts with a complementary latching element of the respective other shell element, with the result that the two shell elements form the housing according to the invention in the latched state with respect to one another. It is provided here, furthermore, that the latching elements and the complementary latching elements of the shell elements are of multiple-step configuration. According to the invention, the entire boundary regions between the shell elements which form the housing are also of multiple-step configuration, with the exception of the openings for the plug-in connector and the cable holder.

The invention provides a housing for a plug-in connection, which housing is distinguished by the fact that only two identical shell elements are required in order to produce the housing. This ensures a both ecologically and economically sound production of the housing for a plug-in connection, since there is a considerable minimization of components in comparison with the prior art. In order to produce the housing, only two identical shell elements are namely necessary according to the invention, which shell elements additionally latch autonomously to one another by way of the latching elements and complementary latching elements according to the invention and thus form the housing according to the invention. The latching action ensures the electromagnetic compatibility, since there is a corresponding seal of the housing as a result of the latching action. It is of course to be taken into consideration here that the material from which the identical shell elements are produced has corresponding shielding properties. The selection of materials of this type is familiar to a person skilled in the art, however. In the assembled state, the open ends of the housing are closed firstly by the corresponding plug-in connector and secondly by way of a cable holder, it also being possible for the cable holder to be configured as an interchangeable insert, with the result that different cable diameters can be used with the housing according to the invention for a plug-in connection. The connection of the cable to the housing can be realized on the corresponding cable holder by way of a crimp closure. It is also possible, however, that a corresponding cable is connected to the housing according to the invention in some other way, as is also already known from the prior art. The plug-in connector is held fixedly and captively in the housing according to the invention in the assembled state by means of the holding elements which are assigned to each shell element. The electromagnetic compatibility of the housing according to the invention is increased once more by way of said multiple-step configuration of the latching elements and the entire boundary regions, since electromagnetic fields and waves are considerably impeded from passage in the latching region of the closed housing by way of the multiple-step construction of the latching elements and complementary latching elements and the entire boundary regions. A corresponding seal of the housing, which seal increases the electromagnetic compatibility, is increased once more as a result.

The shell elements advantageously have action points for a tool on their outer casing, with the result that a housing which has already been closed can be opened again in a simple way by way of a tool.

The refinement of the invention, according to which refinement a depression is provided in the receptacle for the cable holder, into which depression a bead of the cable holder can be received, aims in the same direction, namely to achieve a seal of the housing, which seal increases the electromagnetic compatibility. This ensures that no electromagnetic radiation can pass out of the housing or into the housing directly in the region of the cable holder.

In accordance with another advantageous concept of the invention, the holding element which is arranged in the respective shell element is configured as a separate component which can be inserted into the respective shell element. Even if this appears to be counter-productive with regard to the concept of the invention of using as few different components as possible, this results in the great advantage, however, that considerably simpler molds can be used for producing the shell elements and the holding elements which can be inserted therein. As a result, it is possible, in particular, to produce both the shell elements and the holding elements using the injection molding method and to demold them from the molds in a simple way. Although a single-piece configuration of the respective shell element with the holding element achieves a situation where only one component is required to realize the housing according to the invention, considerably greater costs must be incurred in order to produce a one-piece shell element with holding element of this type with regard to the mold costs. Although the use of two separate components for the holding element and the shell element increases the number of different components by 100%, namely from one component to two components, the advantage that considerably simpler molds can be used during the production of said individual parts here is to be given priority over said disadvantage, since the production of the individual parts also becomes simpler and less susceptible to faults as a result, and ecological and economic aspects are therefore also taken account of.

Here, furthermore, at least one positioning element is advantageously provided in the shell elements, which positioning element interacts with a complementary positioning element of the respective holding element. In this respect, it is possible in a simple way to position the holding element in accordance with its use in the housing in the respective shell element. As a result, faulty positioning and therefore a possibly negative influence on the electromagnetic compatibility of the housing according to the invention are avoided or at least considerably minimized. In addition, this ensures that the holding element is positioned in the housing precisely for secure holding or fixing of the plug-in connector.

In addition, it has proven appropriate here that at least one positioning element of the shell element is configured as a guide element which interacts with a complementary guide element of the holding element. This ensures that, when the holding element is introduced into the respective shell element, the holding element is guided exactly into its target position, in which it firmly holds the plug-in connector securely in the housing in the assembled state of the latter.

It is provided here, furthermore, that in each case one bearing face is provided on the shell elements, on which bearing face a bearing face of the plug-in connector comes to lie in the assembled position. Here, the holding element has a holding mechanism which interacts with the plug-in connector in such a way that the latter is held securely and captively in the housing in the assembled position. This ensures that the bearing faces of the holding element and of the plug-in connector come to lie on one another securely in the assembled position, without it being possible for them to move apart from one another again.

In one particularly advantageous refinement of the invention, the holding mechanism of the holding element has at least one spring arm, on which a latching lug is arranged, the spring arm being configured to engage into a receptacle within a rear wall of the plug-in connector, the latching lug engaging behind the rear wall of the plug-in connector in the assembled position.

Furthermore, it can be provided in an advantageous way that latching lugs are arranged on the holding element, which latching lugs engage into receptacles of the shell elements in the assembled position, and the respective holding element is thus firmly held in the corresponding shell element captively but preferably movably. This ensures that, although the holding elements of the shell elements are already arranged captively on the shell elements during the assembly of the housing, a certain tolerance is provided by way of the movable captive arrangement of the holding elements in the shell elements during the assembly of the housing according to the invention, which tolerance can contribute, during assembly of the housing, to a production or assembly of the housing according to the invention which is less susceptible to faults.

Furthermore, the invention also relates to a plug-in connection having a plug-in connector, a cable holder and an above-described housing.

Further aims, advantages, features and possible uses of the present application emerge from the following description of one exemplary embodiment with reference to the drawings. Here, all the features which are described and/or illustrated in the figures form the subject matter of the present invention on their own or in any desired appropriate combination, even independently of their combination in the claims or the back-reference of said claims.

Figure 2:
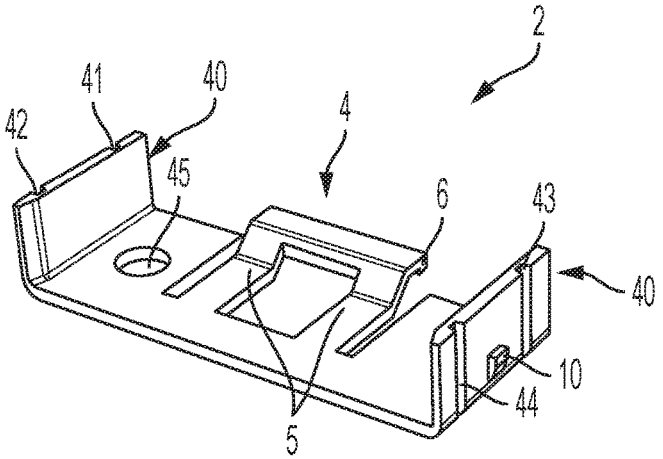
Figure 3:
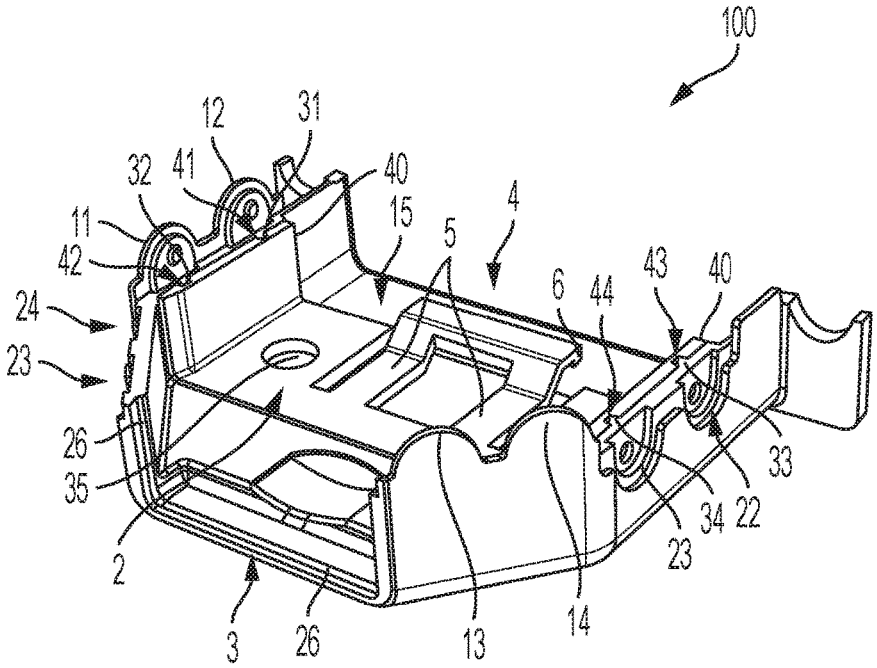
Figure 4:
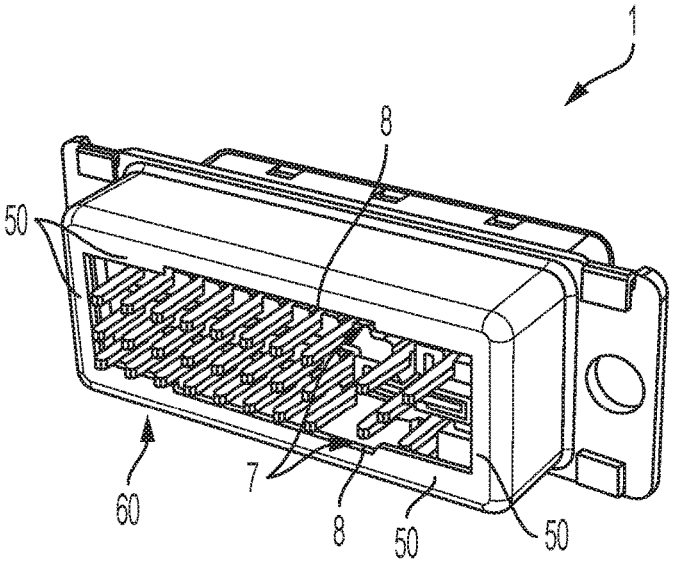
Figure 5:
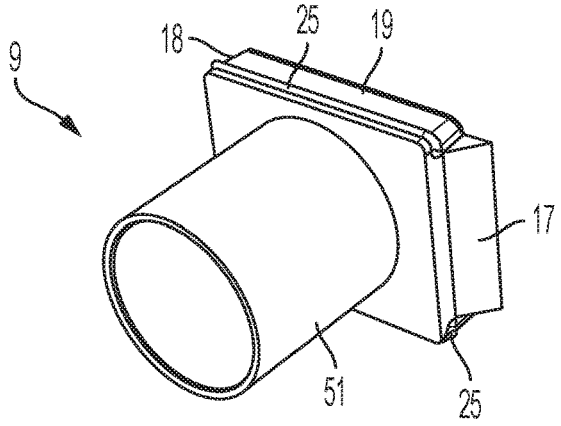
Figure 6:
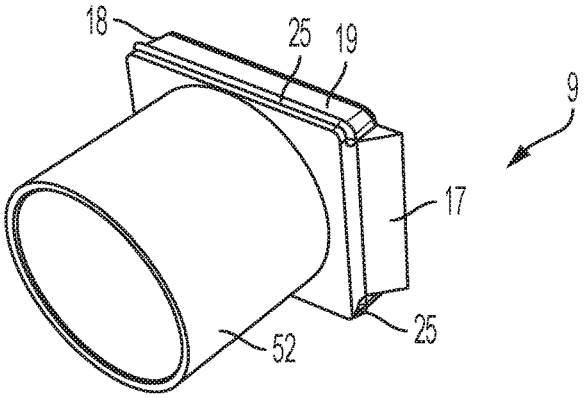
Figure 7:
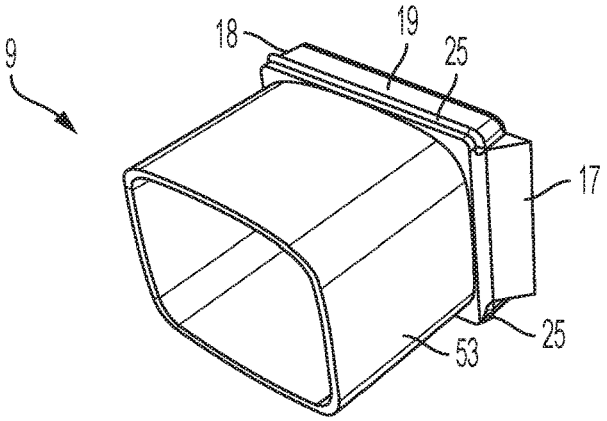
Figure 8:
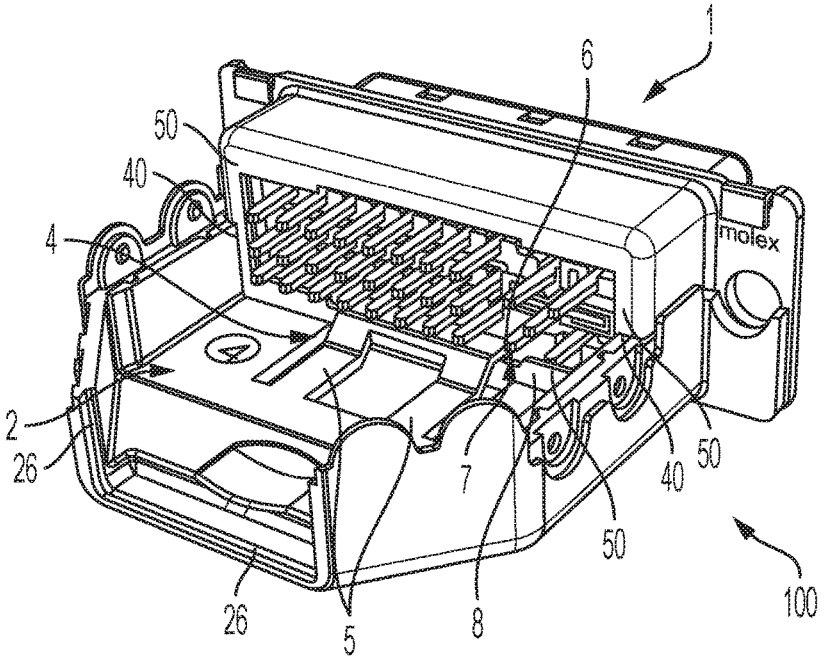
Figure 9:
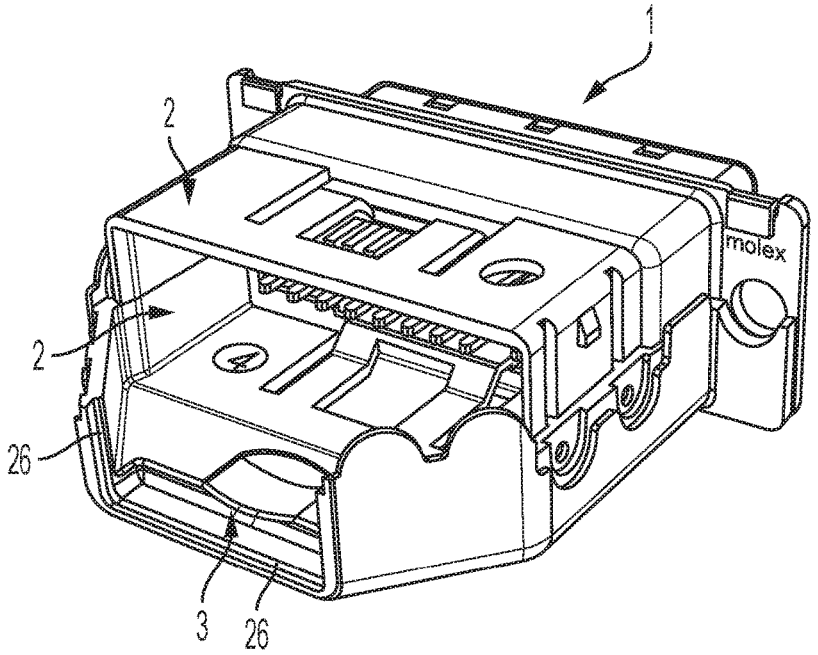
Figure 10:
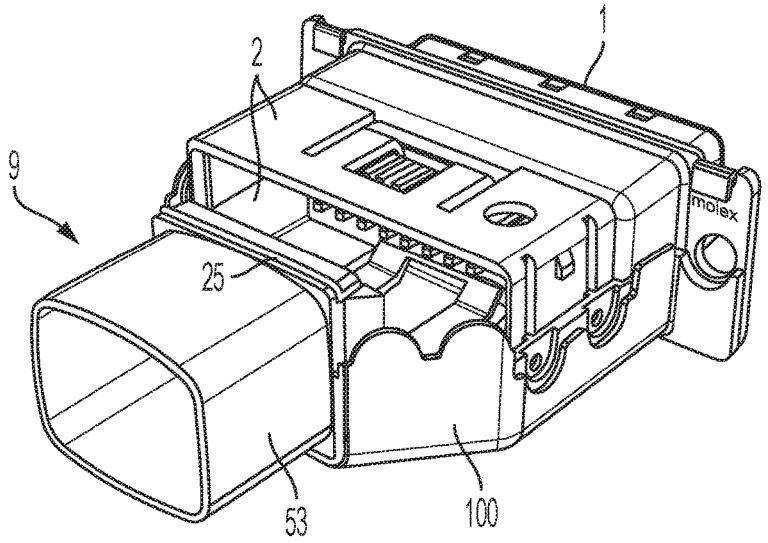
Figure 11:
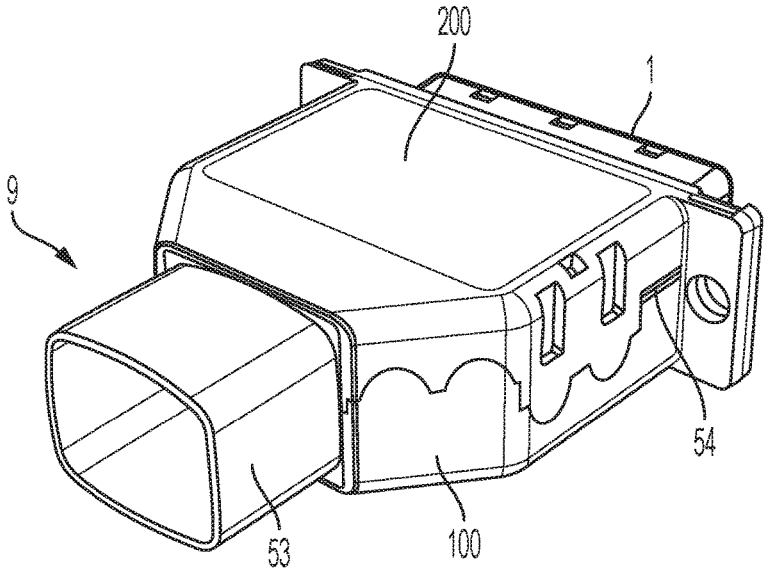
Figure 12:
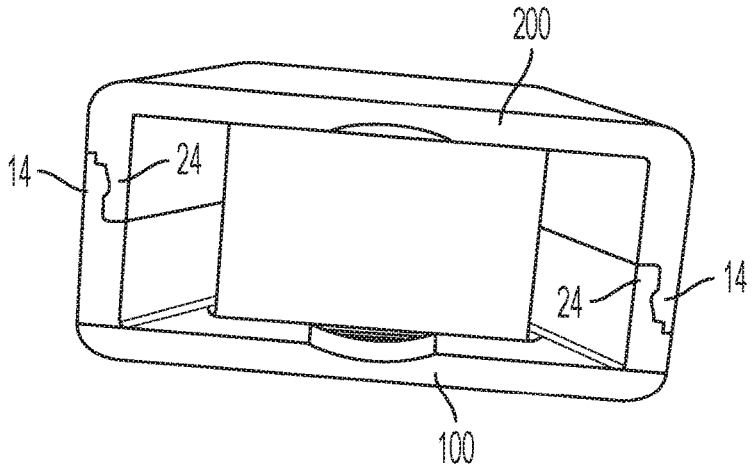
Figure 13:
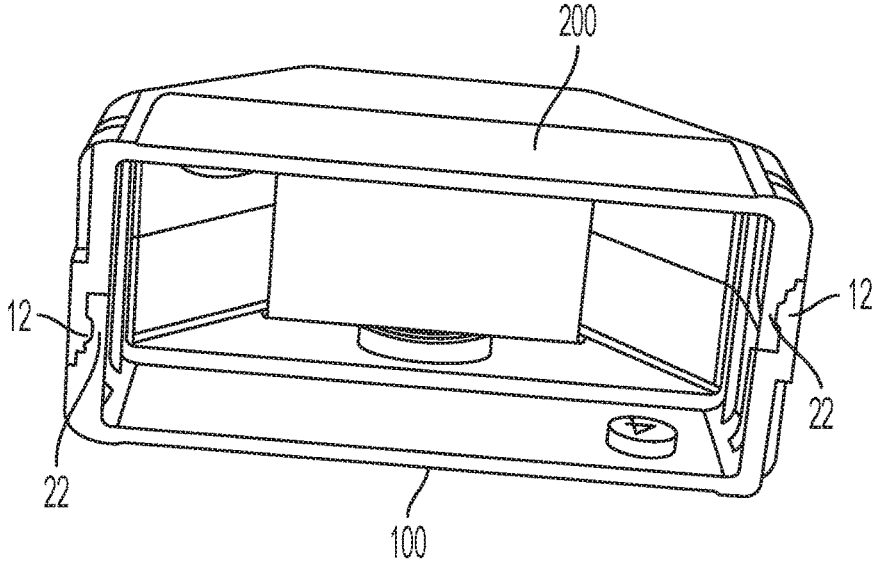
Figure 14:
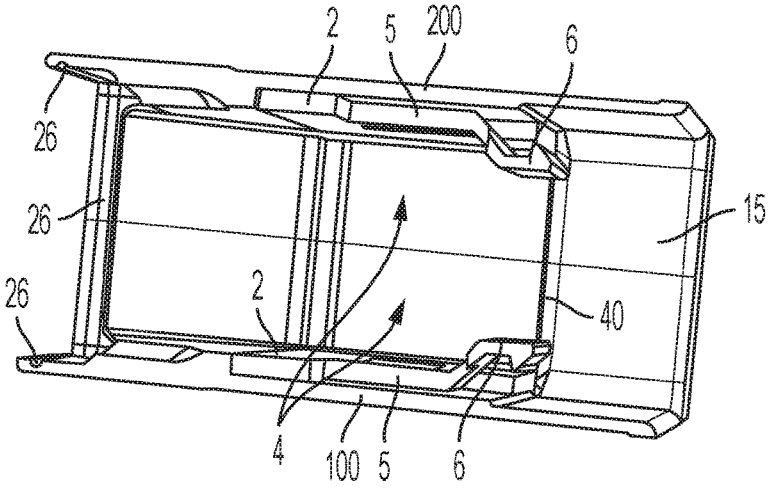
Figure 15:
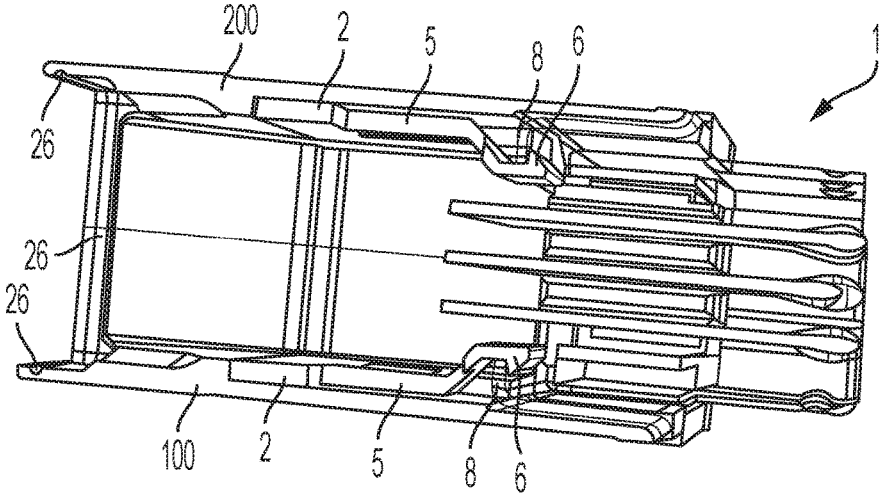

In the drawings:

FIG. 1 shows one exemplary embodiment of a shell element of a housing according to the invention in a perspective view, FIG. 2 shows a holding element for a shell element in accordance with FIG. 1 in a perspective view, FIG. 3 shows the holding element in accordance with FIG. 2, inserted into the shell element in accordance with FIG. 1, in a perspective view, FIG. 4 shows one exemplary embodiment of a plug-in connector for a housing according to the invention in a perspective view, FIG. 5 shows a first exemplary embodiment of a cable holder for a housing according to the invention in a perspective view, FIG. 6 shows a second exemplary embodiment of a cable holder for a housing according to the invention in a perspective view, FIG. 7 shows a third exemplary embodiment of a cable holder for a housing according to the invention in a perspective view, FIG. 8 shows the shell element in accordance with FIG. 3 with an additionally inserted plug-in connector in a perspective view, FIG. 9 shows the shell element in accordance with FIG. 8 with an additionally attached holding element for the upper shell element in a perspective view, FIG. 10 shows the shell element in accordance with FIG. 9 with an additionally inserted cable holder in accordance with FIG. 7 in a perspective view, FIG. 11 shows one exemplary embodiment of a housing according to the invention in a perspective view, FIG. 12 shows a first cross section through the housing in accordance with FIG. 11, FIG. 13 shows a second cross section through the housing in accordance with FIG. 11, FIG. 14 shows a third cross section through the housing in accordance with FIG. 11, and FIG. 15 shows a fourth cross section through the housing in accordance with FIG. 11.

FIG. 1 shows a lower shell element 100 of one exemplary embodiment of a housing according to the invention in a perspective view. Said exemplary embodiment of the housing is a DVI plug housing which, at its one end, has an opening for a DVI plug-in connector 1 in accordance with FIG. 4. At its other end, the housing has an opening, in which a cable holder 9 in accordance with FIGS. 5 to 7 can be fixed. A finally assembled DVI plug housing according to the invention can be gathered from FIG. 11.

The shell element 100 is of substantially rectangular configuration in its front region, in which the DVI plug-in connector 1 is inserted, and contains a clearance 15 there, in which clearance 15 the DVI plug-in connector 1 can be positioned. The shell element 100 tapers conically toward its other end, where it has a receptacle 3 for a cable holder 9. A corresponding cable holder 9 is fixed captively and immovably in said receptacle 3 in the assembled state of the housing in accordance with FIG. 11. Here, the receptacle 3 has a depression 26, into which a bead 25 of the cable holder 9 engages in the assembled state, as a result of which a direct passage of electro-magnetic radiation into the housing and out of the housing is effectively suppressed.

In its front region, the shell element 100 has latching elements 11 and 12 on its one side, which latching elements 11 and 12 correspond with corresponding complementary latching elements 21 and 22 on the other side in the front region of the shell element 100. In the same way, in its rear, conically tapering region, the shell element 100 has latching elements 13 and 14 on the one side, which latching elements 13 and 14 correspond with corresponding complementary latching elements 23 and 24 on the other side in the conically tapering rear region of the shell element 100.

Here, the shell element 100 is of identical configuration with respect to a shell element 200, as is shown in FIG. 11 in the assembled housing. By way of the special identical configuration of the shell elements 100 and 200, they can then be assembled together in a simple way to form the housing in accordance with FIG. 11. Here, the latching elements 11 and 12 of the shell element 100 engage into the complementary latching elements 21 and 22 of the shell element 200 which are not visible in FIG. 11, and the latching elements 13 and 14 of the shell element 100 engage into corresponding complementary latching elements 23 and 24 of the shell element 200 and vice versa.

The special step-shaped configuration of the latching elements 11, 12, 13 and 14 and the complementary latching elements 21, 22, 23 and 24 and of a covering 16 on one side in the front region of the shell elements 16 ensures that the boundary regions of the shell elements 100 and 200 do not form a direct passage in the assembled state and are also of step-shaped configuration. The boundary regions of the shell elements 100 and 200 are arranged in the region of the latching elements 11 to 14 and complementary latching elements 21 to 24 and the covering 16 in the assembled position of the shell elements 100 and 200 in accordance with FIG. 11 in such a way that the boundary regions are of stepped configuration. This can also be gathered more clearly from the sectional illustrations of FIGS. 14 and 15 which are described in even more detail in the following text. This effectively counteracts a direct passage of electromagnetic radiation or electromagnetic fields through the housing, both from the inside to the outside and from the outside to the inside.

Furthermore, the shell element 100 in accordance with FIG. 1 and therefore also the shell element 200 have positioning elements 31 to 35 which correspond with complementary positioning elements 41 to 45 of a holding element 2, as is shown in FIG. 2. Here, the positioning elements 31 to 34 of the shell elements 100 and 200 are configured as guide elements or guide rails which engage into corresponding complementary positioning elements 41 to 44 of the holding element 2 which are configured as guide openings. Furthermore, in their front region, the shell elements 100 and 200 have receptacles 20 on both sides, into which receptacles 20 corresponding latching lugs 10 which are arranged on the holding elements 2 engage. Said latching lugs 10 and receptacles 20 serve to ensure that the holding element 2 can be arranged captively but movably on the shell elements 100 and 200, before their final assembly to form the housing according to the invention.

A holding mechanism 4 can also be seen clearly in FIG. 2, in which the holding element 2 is shown in a separate illustration, by way of which holding mechanism 4 a corresponding plug-in connector 1 can be firmly held securely after the arrangement of the holding element 2 in the respective shell element 100 or 200. In the present case, the holding mechanism 4 consists of two spring arms 5, at the free end of which a latching lug 6 which connects the spring arms 5 is arranged.

Furthermore, the holding element 2 has a bearing face 40, on which a bearing face 50 of the plug-in connector 1 comes to lie in the assembled position.

It is also to be mentioned here that the positioning element 35 of the shell elements 100 and 200 is configured as a circular elevation in the front region of the shell elements 100 and 200, and corresponds with a correspondingly circular opening 45 of the holding element 2.

FIG. 3 then shows how the holding element 2 is arranged in the shell element 100. Here, the positioning elements 31 to 35 of the shell element 100 are positioned in the complementary positioning elements 41 to 45 of the holding element 2. In order that the holding element 2 is not lost from the shell element 100 during handling, the latching lug 10 of the holding element, which latching lug 10 is positioned displaceably within the receptacle 20 of the shell element 100, firmly holds the holding element 2 movably but captively on the shell element 100.

FIG. 4 then shows a DVI plug-in connector 1 which can be positioned in the exemplary embodiment of the housing which is shown here. Here, the plug-in connector 1 has a multiplicity of contacts 60, on which corresponding lines or signal lines of the cable which are not shown in the figures for the sake of clarity can be arranged, for example by way of soldering of the corresponding lines to the contacts.

Here, the plug-in connector 1 additionally has a rear wall 8 which is provided with a bearing face 50 which comes to lie on the bearing face 40 of the holding element 2 in the assembled state. Furthermore, said rear wall 8 has a recess 7, into which the holding mechanism 4 of the holding element 2 can engage. Here, in the assembled state, the latching lug 6 which is arranged on the spring arms 5 of the holding element 2 engages behind the rear wall 8 of the plug-in connector 1 and therefore ensures that the bearing faces 50 and 40 of the plug-in connector and of the holding element come to lie against one another securely in the assembled position and remain in said position.

FIG. 5 shows a solid cable holder 9 which can be inserted into the receptacle 3 of the shell elements 100 and 200. Here, the cable holder 9 has a solid main body 19, on which beveled faces 17 and 18 are arranged. Here, the main body 19 serves to ensure that the cable holder 9 is held securely in the receptacle 3 of the shell elements 100 and 200 in the assembled state of the housing. In order to further strengthen said secure retention, the beveled faces 17 and 18 are provided which are supported in the interior of the shell elements 100 and 200 or the housing on the inner side of the conically tapering end when the main body 19 of the cable holder 9 is received in the receptacle 3 of the shell elements 100 and 200. In addition, the cable holder 9 has a cable opening 51, through which a cable with its multiplicity of lines can be guided. It can be provided here that different cable holders with different diameters of the cable opening 51 are provided, with the result that cables with different diameters can be introduced into the housing.

The illustrations in accordance with FIGS. 6 and 7 show two further exemplary embodiments of cable holders which have different cable openings 52 and 53 respectively, however. It becomes clear as a result that it is possible to use different cables with different cable diameters and/or cable geometries in the same housing.

FIG. 8 then shows how the plug-in connector 1 is held in the housing in the assembled position. Here, for improved clarity, the illustration of the upper casing element 2 has been dispensed with. It can be seen clearly how the bearing faces 40 of the holding element 2 and the bearing faces 50 of the plug-in connector 1 come to lie on one another. In order that the bearing faces 40 and 50 which lie on one another cannot be released from one another, the latching lug 6 of the spring mechanism 4 of the holding element 2 which is held on the spring arms 5 engages behind the rear wall 8 of the plug-in connector 1.

Here, in order to connect the plug-in connector 1 to the housing, the plug-in connector 1 is pushed into the front opening of the housing until the latching lug 6 of the holding element 2 engages into the receptacle 7 on the rear wall 8 of the plug-in connector. During the plugging of the plug-in connector 1 into the housing, the latching lug 6 of the holding element 2 is lifted here via the spring-elastic connection of the spring arms 5, until the latching lug 6 has surmounted the rear wall 8 of the plug-in connector. The spring arms 5 then bring the situation about in which the latching lug 6 engages behind said rear wall 8 of the plug-in connector. In said position, the bearing faces 40 and 50 of the holding element and of the plug-in connector then come to lie on one another, with the result that the plug-in connector is held securely in the housing which is formed by way of the shell elements 100 and 200.

The further FIGS. 9 to 11 then show the successive construction of the housing with the cable holder 9 and the plug-in connector 1, and the holding elements 2 and the shell elements 100 and 200. It is to be noted once again here that, on account of improved representability, the illustration of the cable which contains the lines or signal lines has been dispensed with. The bead 25 of the cable holder 9, which bead 25 is received in the depression 26 of the receptacle 3 of the shell element 200 in the assembled state, can be seen clearly here in FIG. 11.

FIGS. 12 and 13 then show different sections of the housing, in order once again to demonstrate the sealed nature of the housing according to the invention with regard to electromagnetic radiation and the secure retention of the plug-in connector 1 in the housing.

Here, FIG. 12 shows a cross section in the rear region of the housing through the latching elements 13 and 14 and complementary latching elements 23 and 24 of the shell elements 100 and 200. As can be seen clearly here, it is not possible for electromagnetic radiation or electromagnetic fields to penetrate the boundary regions in the connecting region of the two shell elements 100 and 200 in a simple way, since said boundary regions are stepped over their entire longitudinal extent.

This is also clarified once more by way of the sectional illustration of FIG. 13 which shows a section through the latching elements 12 and complementary latching elements 22 of the shell elements 100 and 200.

FIG. 14 shows a longitudinal section through the housing according to the invention; the holding elements 2, which are held in the shell elements 100 and 200, with their holding mechanism 4, consisting of the spring arms 5 and the latching lug 6, can be seen clearly here. Furthermore, the clearance 15 within the housing for the plug-in connector 1 and the bearing face 40 of the holding element 2 can also be seen clearly in said illustration.

FIG. 15 then shows the housing after the plug-in connector 1 has been pushed into the clearance 15, until the bearing face 50 on the rear wall 8 of the plug-in connector comes to lie on the bearing face 40 of the holding element 2. It can be seen clearly here how the latching lug 6 of the holding mechanism 4 of the holding element 2 engages behind the rear wall 8 of the plug-in connector 1 and therefore ensures the secure retention of the plug-in connector 1 in the housing.

The manufacturing operation for producing the plug-in connection with the housing according to the invention can be as follows here:

First of all, the cable holder 9 is pushed over the cable which contains the lines or signal lines.

Afterward, the individual lines or signal lines of the cable are connected to the contacts 60 of the plug-in connector 1.

Subsequently, the casing halves 100 and 200 which form the actual housing are plugged by way of the holding elements 2 which are already arranged in them onto the cable holder 9 in such a way that said cable holder 9 is held securely in the housing. Here, in interaction with the complementary latching elements 21 to 24, the latching elements 11 to 14 close the two casing elements 100 and 200 to form the housing according to the invention. Subsequently, the plug-in connector is pushed into the housing until the latching lugs 6 of the holding elements 2 which are arranged in the shell elements 100 and 200 engage behind the rear wall 8 of the plug-in connector 1 and therefore latch in by way of the spring force of the spring arms 5. In this position, the plug-in connector 1 is held securely in the housing. Finally, the cable on the cable holder 9 is connected fixedly to the cable holder 9 by way of a crimp closure, with the result that a tensile relief is also ensured with regard to the line connection.

The casing elements 100 and 200 of the housing can be released from one another again by means of an action opening 54, as shown in FIG. 11, by a tool being introduced there and the connection of the latching elements 11 to 14 to the complementary latching elements 21 to 24 of the shell elements 100 and 200 being released again.

LIST OF DESIGNATIONS

1 Plug-m connector
2 Holding element
3 Receptacle
4 Holding mechanism
5 Spring arm
6 Latching lug
7 Receptacle
8 Rear wall
9 Cable holder
10 Latching lug
11 Latching element
12 Latching element
13 Latching element
14 Latching element
15 Clearance
16 Covering
17 Face
18 Face
19 Main body
20 Receptacle
21 Complementary latching element
22 Complementary latching element
23 Complementary latching element
24 Complementary latching element
25 Bead
26 Depression
31 Positioning element
32 Positioning element
33 Positioning element
34 Positioning element
35 Positioning element
40 Bearing face
41 Complementary positioning element
42 Complementary positioning element
43 Complementary positioning element
44 Complementary positioning element
45 Complementary positioning element
50 Bearing face
51 Cable opening
52 Cable opening
53 Cable opening
54 Action opening
60 Contacts
100 Shell element
200 Shell element

What is claimed is:

1. A housing for a plug-in connection, comprising:

a lower shell element, and an upper shell element which is identical to the lower shell element, a holding element being arranged in each shell element, by way of which holding element a plug-in connector can be fastened to the housing, and a receptacle being provided in each shell element, in which receptacle a cable holder can be received, and each shell element having at least one latching element which interacts with a complementary latching element of the respective other shell element, the latching elements and the complementary latching elements being of multiple-step configuration, characterized in that entire boundary regions between the shell elements which form the housing are also of multiple-step configuration except for openings for the plug-in connector and the cable holder, wherein a bearing face is provided on the holding element, wherein a bearing face of the plug-in connector contacts a portion of the bearing face of the holding element in an assembled position, wherein die holding element has a holding mechanism which interacts with the plug-in connector in such a way that the latter is held securely and captively in the housing in the assembled position, and wherein the holding mechanism of the holding element has at least one spring arm, on which a latching lug is arranged, and which spring arm is configured to engage into a receptacle within a rear wall of the plug-in connector, the latching lug engaging behind the rear wall of the plug-in connector in the assembled position.

2. The housing as claimed in claim 1, wherein a depression is provided in the receptacle for the cable holder, in which depression a bead of the cable holder can be received.

3. The housing as claimed in claim 1, wherein the holding element which is arranged in the respective shell element is configured as a separate component which can be inserted into the respective shell element.

4. The housing as claimed in claim 3, wherein at least one positioning element is provided in the shell elements, which at least one positioning element interacts with a complementary positioning element of the respective holding element.

5. The housing as claimed in claim 4, wherein at least one positioning element of the shell elements is configured as a guide element which interacts with a complementary positioning element of the holding element, which complementary positioning element is configured as a complementary guide element.

6. The housing as claimed in claim 3, wherein latching lugs are arranged on the holding element, which latching lugs engage into receptacles of the shell elements in the assembled position, and the respective holding element is thus fixedly held captively but movably in the corresponding shell element.

7. A housing for a plug-in connection, comprising:

a lower shell element;

an upper shell element which is identical to the lower shell element, a holding element being arranged in each shell element, by way of which holding element a plug-in connector can be fastened to the housing; and a receptacle being provided in each shell element, in which receptacle a cable holder can be received, each shell element having at least one latching element which interacts with a complementary latching element of the respective other shell element, the latching elements and the complementary latching elements being of multiple-step configuration, characterized in that entire boundary regions between the shell elements which form the housing are also of multiple-step configuration except for openings for the plug-in connector and the cable holder, wherein the holding element which is arranged in the respective shell element is configured as a separate component which can be inserted into the respective shell element, and wherein latching lugs are arranged on the holding element, which latching lugs engage into receptacles of the shell elements in the assembled position, and the respective holding element is thus fixedly held captively but movably in the corresponding shell element.

8. The housing as claimed in claim 7, wherein a depression is provided in the receptacle for the cable holder, in which depression a bead of the cable holder can be received.

9. The housing as claimed in claim 7, wherein at least one positioning element is provided in the shell elements, which at least one positioning element interacts with a complementary positioning element of the respective holding element.

10. The housing as claimed in claim 9, wherein at least one positioning element of the shell elements is configured as a guide element which interacts with a complementary positioning element of the holding element, which complementary positioning element is configured as a complementary guide element.

* * * * *